US010060143B2

(12) United States Patent
Calmes

(10) Patent No.: US 10,060,143 B2
(45) Date of Patent: Aug. 28, 2018

(54) FORMLINER LAYOUT MEMBER

(75) Inventor: Shane Calmes, Onalaska, WI (US)

(73) Assignee: ADVANCED FORMLINERS, Onalaska, WI (US)

( * ) Notice: Subject to any disclaimer, the term of this patent is extended or adjusted under 35 U.S.C. 154(b) by 1082 days.

(21) Appl. No.: 13/400,448

(22) Filed: Feb. 20, 2012

(65) Prior Publication Data

US 2013/0075576 A1 Mar. 28, 2013

Related U.S. Application Data

(60) Provisional application No. 61/540,448, filed on Sep. 28, 2011.

(51) Int. Cl.
*E04G 9/10* (2006.01)
*B28B 19/00* (2006.01)

(52) U.S. Cl.
CPC ..... *E04G 9/10* (2013.01); *B28B 19/0061* (2013.01); *Y10T 29/49826* (2015.01)

(58) Field of Classification Search
CPC .. E04G 9/10; B28B 19/0061; Y10T 29/49826
USPC ..... 249/16, 112, 113, 189, 192; 428/163, 428/603, 604; 52/537, 592.1, 672, 674
See application file for complete search history.

(56) References Cited

U.S. PATENT DOCUMENTS 636,200 A 10/1899 Frink
777,656 A 12/1904 Banning
1,564,578 A * 12/1925 Kennedy ..... 264/33
1,809,504 A * 6/1931 Carvel ..... 52/745.11
1,945,024 A 1/1934 Coil et al.
2,022,784 A * 12/1935 Rice ..... E04B 5/29 249/31
2,114,710 A 4/1938 Holcomb
2,283,968 A * 5/1942 Bunch ..... 249/165
2,355,967 A * 8/1944 Greenwalt ..... 249/140
2,465,871 A 3/1949 Hardie et al.
2,627,100 A 2/1953 Jelks
2,654,935 A 10/1953 Ager
2,782,469 A * 2/1957 Hargraves et al. ..... 249/102
2,858,247 A 10/1958 Swart
2,876,927 A 3/1959 Henning
2,964,800 A 12/1960 Dorsett
2,974,716 A 3/1961 Fourness
(Continued)

FOREIGN PATENT DOCUMENTS

EP 449584 A1 * 10/1991 ..... B28B 7/36
JP 03082508 A * 4/1991 ..... B29C 39/10
(Continued)

OTHER PUBLICATIONS

U.S. Appl. No. 61/540,448, filed Sep. 28, 2011. Inventor: Shane Calmes.
(Continued)

*Primary Examiner* — Matthew J Daniels
*Assistant Examiner* — Leith S Shafi
(74) *Attorney, Agent, or Firm* — Vidas, Arrett & Steinkraus

(57) ABSTRACT

In some embodiments, a form liner system comprises a form liner sheet comprising a plurality of raised rows at a predetermined spacing, and a layout member comprising a base portion and a plurality of raised portions. The raised portions are constructed and arranged to nest with said raised rows.

17 Claims, 14 Drawing Sheets

(56) References Cited

U.S. PATENT DOCUMENTS

| | | | | | |
|---|---|---|---|---|---|
| 3,349,158 | A | | 10/1967 | Maynard | |
| 3,382,640 | A | | 5/1968 | Thomas et al. | |
| 3,411,257 | A | | 11/1968 | Yaremchuk | |
| 3,419,457 | A | | 12/1968 | Bleasdale | |
| 3,530,029 | A | * | 9/1970 | Lemelson | 425/506 |
| 3,594,968 | A | | 7/1971 | Johnson | |
| 3,602,476 | A | | 8/1971 | Iragorri | |
| 3,783,087 | A | | 1/1974 | Vecchiarelli | |
| 3,801,405 | A | | 4/1974 | Corkery et al. | |
| 4,011,702 | A | | 3/1977 | Matyas | |
| 4,133,481 | A | | 1/1979 | Bennett | |
| 4,239,824 | A | | 12/1980 | Kasten | |
| 4,393,108 | A | | 7/1983 | Barker et al. | |
| 4,695,033 | A | * | 9/1987 | Imaeda et al. | 249/189 |
| 4,858,410 | A | | 8/1989 | Goldman | |
| 4,859,511 | A | | 8/1989 | Patterson et al. | |
| 4,888,928 | A | * | 12/1989 | Rea et al. | 52/387 |
| 4,889,758 | A | | 12/1989 | Rinkewich | |
| 4,923,733 | A | | 5/1990 | Herbst | |
| 4,963,054 | A | | 10/1990 | Hayashi | |
| 5,002,817 | A | * | 3/1991 | Jones | 428/159 |
| 5,006,011 | A | | 4/1991 | Hiyashi | |
| 5,038,541 | A | | 8/1991 | Gibbar, Jr. | |
| 5,074,517 | A | * | 12/1991 | Scott | 249/112 |
| 5,162,150 | A | | 11/1992 | Buis et al. | |
| 5,242,738 | A | | 9/1993 | Furuya et al. | |
| 5,268,137 | A | | 12/1993 | Scott et al. | |
| 5,268,213 | A | | 12/1993 | Murakami et al. | |
| 5,277,009 | A | | 1/1994 | Yamaguchi et al. | |
| 5,421,670 | A | * | 6/1995 | Meirick | 404/124 |
| 5,489,462 | A | | 2/1996 | Sieber | |
| 5,540,411 | A | * | 7/1996 | Strickland | 249/145 |
| 5,667,190 | A | | 9/1997 | Scott et al. | |
| 5,701,710 | A | | 12/1997 | Tremelling | |
| 5,787,667 | A | | 8/1998 | Sheahan et al. | |
| 5,822,937 | A | | 10/1998 | Mahony et al. | |
| 5,887,846 | A | | 3/1999 | Hupp | |
| 5,900,180 | A | | 5/1999 | Scott et al. | |
| 5,950,383 | A | * | 9/1999 | Williamson | E04D 3/38 52/408 |
| 6,041,567 | A | | 3/2000 | Passeno | |
| 6,059,257 | A | | 5/2000 | Scott, III | |
| 6,127,020 | A | | 10/2000 | Bacon, Jr. et al. | |
| 6,164,037 | A | | 12/2000 | Passeno | |
| 6,335,073 | B1 | | 1/2002 | Kock et al. | |
| D479,614 | S | * | 9/2003 | Scott et al. | D25/199 |
| 6,857,248 | B2 | | 2/2005 | Ouellet et al. | |
| 7,658,050 | B2 | | 2/2010 | Bouchard et al. | |
| 7,871,054 | B2 | | 1/2011 | Walters | |
| 7,963,499 | B2 | | 6/2011 | Fitzgerald et al. | |
| D648,450 | S | * | 11/2011 | Drummond | D25/199 |
| 8,074,957 | B2 | * | 12/2011 | Fitzgerald et al. | 249/16 |
| 8,181,930 | B2 | * | 5/2012 | Fasching et al. | 249/15 |
| 8,852,724 | B2 | * | 10/2014 | Calmes | 428/178 |
| 2002/0106504 | A1 | | 8/2002 | Stott | |
| 2004/0226230 | A1 | | 11/2004 | Ritzer | |
| 2005/0064128 | A1 | | 3/2005 | Lane et al. | |
| 2005/0097827 | A1 | | 5/2005 | Jordan | |
| 2006/0091282 | A1 | | 5/2006 | Walters | |
| 2006/0131475 | A1 | * | 6/2006 | Testa | 249/207 |
| 2006/0157634 | A1 | | 7/2006 | Nasvik | |
| 2006/0180731 | A1 | * | 8/2006 | Scott et al. | 249/15 |
| 2007/0151184 | A1 | | 7/2007 | Wise et al. | |
| 2007/0209308 | A1 | | 9/2007 | Barrett | |
| 2007/0217865 | A1 | | 9/2007 | Castonguay et al. | |
| 2009/0100774 | A1 | | 4/2009 | Fasching et al. | |
| 2009/0100776 | A1 | * | 4/2009 | Seccombe | 52/414 |
| 2010/0071308 | A1 | * | 3/2010 | Fitzgerald et al. | 52/741.1 |
| 2010/0155569 | A1 | * | 6/2010 | Walters et al. | 249/16 |
| 2010/0314527 | A1 | | 12/2010 | Fitzgerald et al. | |
| 2012/0074604 | A1 | * | 3/2012 | Calmes | 264/31 |

FOREIGN PATENT DOCUMENTS

| | | | | | |
|---|---|---|---|---|---|
| JP | 03137357 | A | * | 6/1991 | E04G 9/05 |
| JP | 05039666 | A | * | 2/1993 | E04G 9/10 |
| JP | 05044340 | A | * | 2/1993 | E04G 9/10 |

OTHER PUBLICATIONS

U.S. Appl. No. 12/706,633, filed Feb. 16, 2010. Inventor: Shane Calmes.

U.S. Appl. No. 12/047,128, filed Mar. 12, 2008. Inventor: Shane Calmes.

* cited by examiner

FORMLINER LAYOUT MEMBER

CROSS-REFERENCE TO RELATED APPLICATIONS

This application claims the benefit of U.S. Patent Application No. 61/540,448, filed Sep. 28, 2011, the entire disclosure of which is hereby incorporated herein by reference.

BACKGROUND OF THE INVENTION

This invention relates generally to formliners and more specifically to a form liner layout member that helps to maintain proper spacing and orientation of formliner sheets, thereby providing a more desirable cured wall.

Formliners are known in the industry and are often used with objects, such as "thin brick" inserts, to create a cast wall that appears to be traditional masonry. For example, thin bricks can be placed in a formliner that has a grid layout in a masonry pattern. Concrete can then be poured onto the formliner and thin bricks and allowed to cure, thus casting the thin bricks in the concrete panel. When the formliner is removed, the front face of the panel resembles traditional masonry. Some examples of formliners are described in U.S. patent application Ser. No. 12/706,633 and U.S. Pat. No. 7,871,054, the entire disclosures of which are hereby incorporated by reference in their entireties.

Formliners can suffer from problems of deformation due to applied loads and temperature change. Temperature alone can change the actual dimensions of a formliner sheet and cause migration in the specific location of joints. Further, the dimensions of a formliner sheet can change as materials are placed upon the formliner, for example due to deformation. When casting a wall panel using multiple formliner sheets, slight changes in the size and/or shape of the individual formliner sheets can result in noticeable changes in a resulting cured wall, such as misalignment of brick coursings.

When multiple formliner sheets are used, the sheets are typically butted together or overlapped such that a single, continuous cured wall panel is formed. Often the resulting wall may show evidence that multiple formliners were used, for example including a line or visible seam at the locations where individual formliners met.

There has also been difficulty in creating a wall having an angle or joint, for example at locations where two non-parallel walls meet, along walls at recesses for doors and windows, etc. To form a wall termination having brick fascia oriented at angles to one another, contractors have placed prior art formwork butted together at angles to one another. Although this does create a formwork pattern, the formliners generally do not mate well or seal against one another, and concrete slurry can migrate between and behind the formliners. This migration leads to imperfections in the finished panel.

There remains a need for a formliner system capable of maintaining an intended orientation regardless of temperature changes and loading conditions. There remains a need for a formliner system capable of using multiple formliner sheets to create a wall that appears to have been formed using a single, continuous formliner sheet.

There remains a need for a formliner system capable of providing for joints, angles and corners, and for reducing the difficulty involved in creating a high quality cast wall.

U.S. Patent Application No. 61/540,448, U.S. patent application Ser. No. 12/706,633 and U.S. Pat. No. 7,871,054 are hereby incorporated herein by reference in their entireties. All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a form liner system comprises a form liner sheet comprising a plurality of raised rows at a predetermined spacing, and a layout member comprising a base portion and a plurality of raised portions. The raised portions are constructed and arranged to nest with said raised rows.

In some embodiments, a layout member comprises a first portion oriented at an angle to a second portion and a plurality of raised portions, wherein each raised portion extends from the first portion to the second portion. The first portion comprises a jog and a stepped portion.

In some embodiments, a layout member consists of a base having several raised portions, said raised portions extending parallel to one another and being equally spaced along a length of the base.

In some embodiments, a layout member consists of an elongate base portion having a plurality of parallel raised portions, the raised portions oriented at a predetermined equal spacing. In some embodiments, each raised portion has end caps.

In some embodiments, a comprises providing a form liner sheet comprising a plurality of raised rows at a predetermined spacing and providing a layout member comprising a base portion and a plurality of raised portions. The form liner sheet and layout member are oriented in an overlapping arrangement, wherein said raised portions nest with said raised rows.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
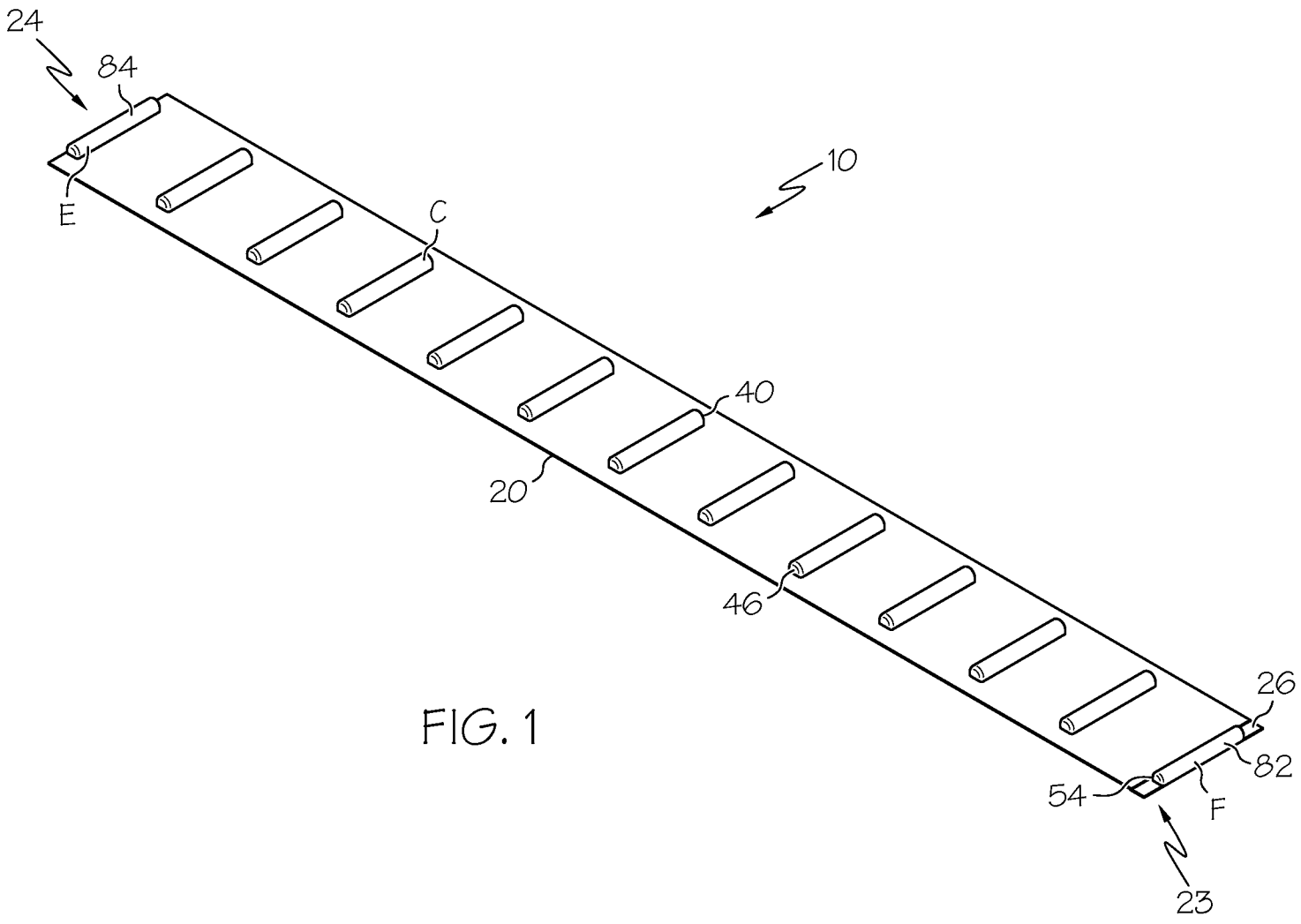
FIG. 1 shows an embodiment of a layout member.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a layout member 10. Desirably, a layout member 10 comprises a base portion 20 and a plurality of raised portions 40. Desirably, the raised portions 40 extend parallel to one another. In at least some embodiments, the raised portions 40 are spaced at regular intervals along a length of the base portion 20, such as being spaced according to a standard spacing of mortar joint rows in masonry construction.

In some embodiments, the base portion 20 extends outward beyond ends of the raised portions 40, wherein a width of the base portion 20 exceeds a span of each raised portion 40. In some embodiments, a raised portion 40 can extend to an edge of the base portion 20.

In some embodiments, the raised portions 40 of a layout member 10 are similar to one another in size and shape. In some embodiments, various raised portions 40 can be different in size and/or shape. In some embodiments, various raised portions can span different amounts of the width of the base portion 20. In some embodiments, some raised portions 40 extend to an edge of the base portion 20, while other raised portions 40 do not. In some embodiments, one end of a raised portion 40 can extend to an edge of the base portion 20 while the other end of the raised portion 40 does not extend to an opposite edge of the base portion 20.

In some embodiments, at least one end of a raised portion 40 comprises a cap 46, wherein the end of the raised portion 40 is solid (e.g. does not include any aperture). In some embodiments, each end of a raised portion 40 comprises a cap 46. The presence of end caps 46 on the raised portions provides greater strength and increases resistance to deformation, for example under applied loads.

In some embodiments, an end 23 of a layout member 10 is arranged for overlap with another member, such as another layout member 10. In some embodiments, an end 23 comprises a stepped portion 26, wherein a plane of the stepped portion 26 is offset from a plane of the rest of the base portion 20. In some embodiments, the stepped portion 26 is formed by having a jog 54 in the base member 20. In some embodiments, a stepped portion 26 can be formed by reducing the thickness of the base member 20.

In some embodiments, at least one raised portion 40 comprises a hollow underside. In some embodiments, each raised portion 40 comprises a hollow underside. When a raised portion 40 located at a second end 24 of a layout member 10 has a hollow underside, it is desirably able to overlay and nest with a raised portion 40 of another layout member 40, for example as shown in FIG. 2.

Figure 2:
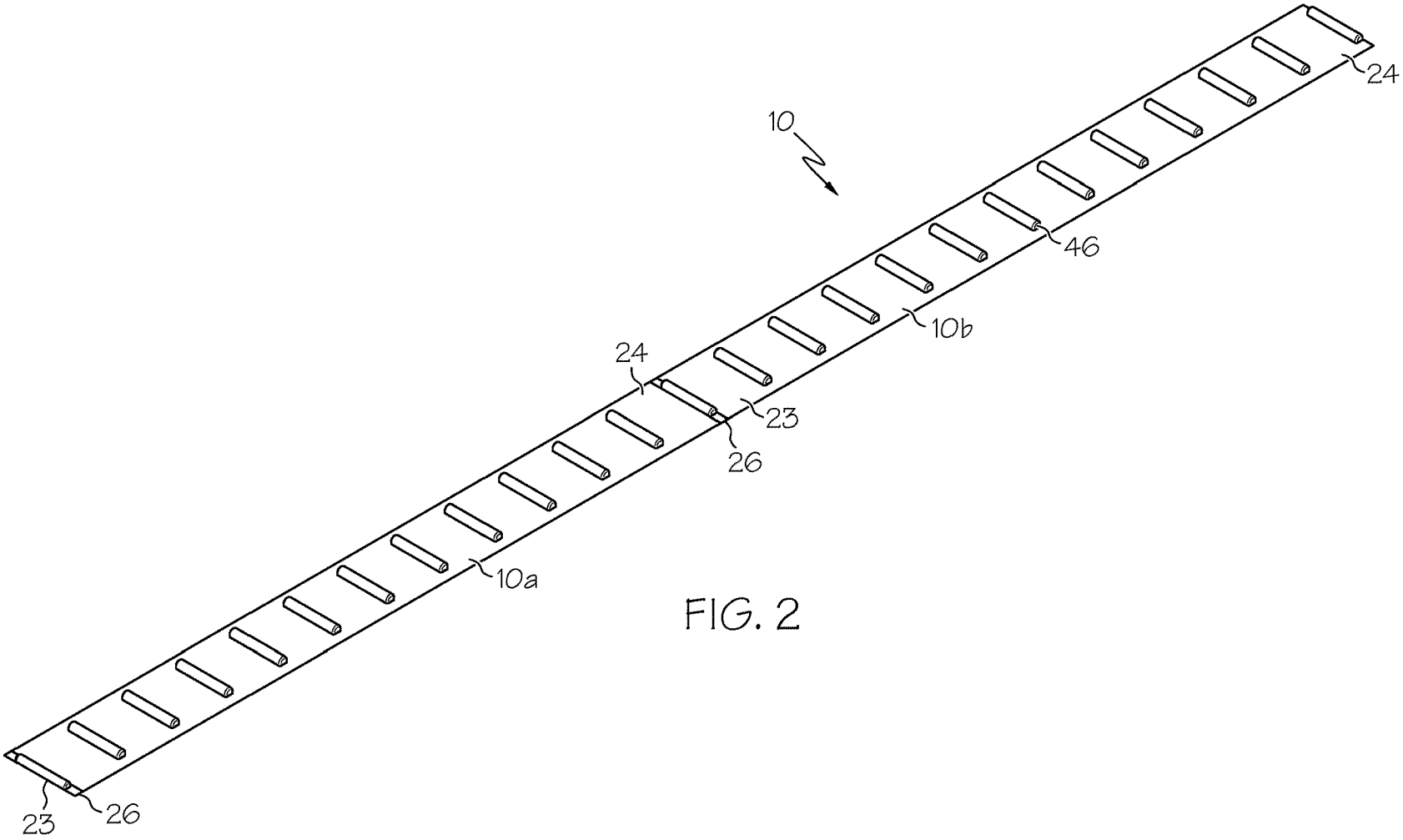
FIG. 2 shows two examples of an embodiment of a layout member.

FIG. 2 shows two similar layout members 10 oriented such that a second end 24 of one layout member 10*a* is positioned over a first end 23 of a second layout member 10*b*. In this manner, any number of layout members 10 can be used to create a collective layout member of any desired length.

In some embodiments, a stepped portion 26 allows for a more seamless continuous upper surface across the layout members 10*a*, 10*b* (e.g. the upper surfaces of the base portions 20 of the layout members 10*a*, 10*b* lie in the same plane).

In some embodiments, a stepped portion 26 comprises a raised portion 40. In such embodiments, desirably the raised portion 40 located on the stepped portion 26 can nest underneath a raised portion 40 of another layout member 10.

In some embodiments, the raised portions 40 comprise surface texturing, for example a texturing designed to make concrete appear visually similar to traditional mortar. In various embodiments, any portion of a layout member 10 can comprise surface texturing.

Figure 3:
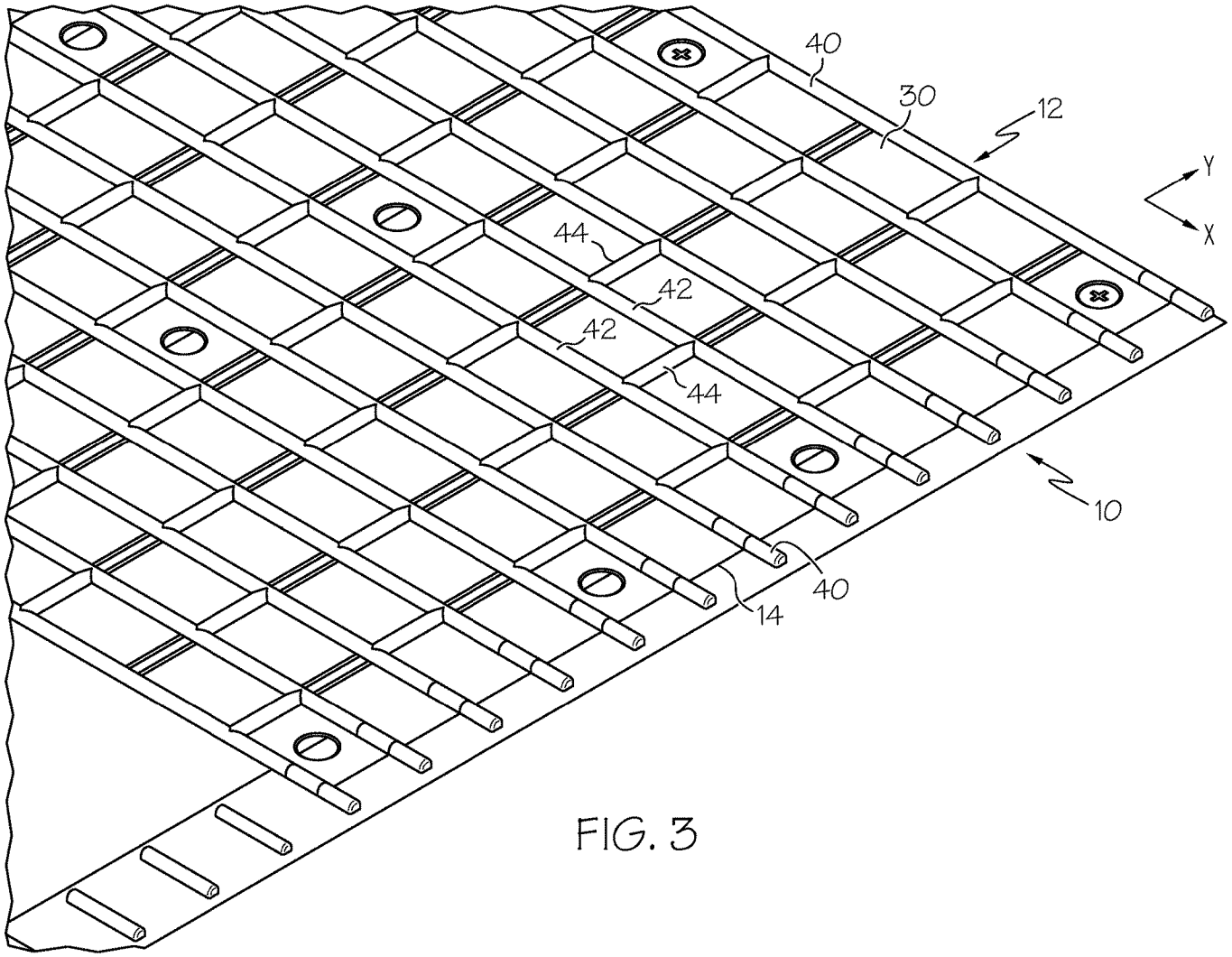
FIG. 3 shows a layout member being used in combination with a form liner sheet.

FIG. 3 shows an embodiment of a layout member 10 being used in combination with a form liner sheet 12. The form liner sheet 12 is configured to create a cured wall that resembles traditional brick and mortar construction using thin brick inserts.

In some embodiments, a form liner sheet 12 comprises a plurality of cells 30. In some embodiments, a form liner sheet 12 comprises a plurality of raised portions 40. Raised portion(s) 40 extend around and define cells 30. A cell 30 can have any suitable shape and can be of any suitable size. Raised portions 40 can also be of any suitable size and shape.

In some embodiments, a form liner sheet 12 defines a plurality of cells 30 having a similar size and shape. In some embodiments, cells 30 of a similar shape are arranged in a repeating pattern. When the cells 30 are designed to resemble a brick layout, the raised portions 40 can comprise row members 42 and column members 44 arranged in a repeating pattern. In some embodiments, a cell 30 is surrounded by two row members 42 and two column members 44.

In some embodiments, at least a portion of a form liner sheet 12 comprises texturing. For example, the raised portions 40 can include texturing to resemble the appearance of mortar.

Desirably, a layout member 10 is configured to be used with a form liner sheet 12. Thus, the raised portions 40 of the layout member 10 and at least some of the raised portions 40 of the form liner sheet 12 can be similar in size, shape and spacing. In some embodiments, the raised portions 40 of a layout member 10 are dimensioned to nest underneath, or on top of, a raised portion 40 of the form liner sheet 12. In some embodiments, the spacing of raised portions 40 on the layout member 10 is similar to the spacing of the row members 42 of the form liner sheet 12.

A layout member 10 can have any suitable number of raised portions 40. Each raised portion can help to brace the form liner sheet 12. In some embodiments, a layout member 10 includes less raised portions than a form liner sheet 12. In some embodiments, a layout member 10 includes the same number of raised portions as a form liner sheet 12

A layout member 10 can be used to dimensionally lay out form liner sheets 12 and maintain proper orientation of the form liner sheets 12.

When using multiple form liner sheets 12 to cast a wall, any error in the individual form liner sheets 12 can be compounded, and longer spans tend to introduce greater amounts of error. A casting bed may extend for a predetermined length and require form liner sheets 12 to be used to span the entire predetermined length. Often one end of a form liner sheet 12 can be placed against an end of the casting bed, thereby determining a starting location for the cast wall. As form liner sheets 12 are laid out, error can be introduced in both the x and y dimensions as shown on FIG. 3. Such error may stem from temperature change, dimensional change of the form liner sheets 12 under loading, other factors and combinations thereof. Layout members 10 can be used to mitigate any such errors.

For example, layout members 10 can be laid out in the casting bed such that the raised portions 40 are located at their proper locations along they dimension of FIG. 3. The layout members 10 can be secured to the casting bed to prevent migration, for example using fasteners or an adhesive. Thus, a layout member 10 acts as a guide for a form liner sheet 12 that overlaps the layout member 10, wherein the raised portions 40 of the layout member 10 can nest underneath raised portions 40 of the form liner sheet 12. This assures that coursings of the row members 42 are oriented properly with respect to the casting bed.

The layout member 10 also helps to prevent inaccuracies caused by temperature change. A layout member 10 can be overlapped by any suitable amount of a form liner sheet 12 while still producing a cured wall of desired appearance. An actual location of an edge 14 of a form liner sheet 12 can vary in the x dimension of FIG. 3 without changing the appearance of an eventual cured wall.

A layout member 10 can be used mid-span with respect to a form liner sheet 12. A layout member 10 can be used at a location where two form liner sheets 12 meet. Desirably, a first portion of a layout member 10 can be oriented under a first form liner sheet 12 and a second portion of the layout member 10 can be oriented under a second form liner sheet 12. For example, FIG. 3 shows a first portion (approximately half) of a layout member 10 oriented underneath a form liner sheet 12. In some embodiments, multiple form liner sheets 12 can overlap one another in addition to overlaying a layout member 10. In some embodiments, multiple form liner sheets 12 butt together without overlapping one another. In some embodiments, multiple form liner sheets 12 each overlay a portion of a layout member 10 but do not contact one another.

In some embodiments, a form liner sheet 12 may have less strength then typical form liner sheets, for example if the form liner sheet 12 is made from foam. A layout member 10 can provide rigidity that maintains orientation of such weaker form liner sheets 10. Weaker form liner sheets 12 tend to be more likely to leave evidence of a seam than stronger form liner sheets 12, and a layout member 10 can help hide seams that are traditionally formed when using weaker form liner sheets 12.

In some embodiments, a layout member 10 comprises an adhesive. Thus, the form liner sheets 12 can be attached to the layout members 10 via the adhesive. In some embodiments, layout member 10 is provided with an adhesive layer as well as a removable protective layer.

In some embodiments, an adhesive can be supplied separately from the form liner sheets 12 and layout member(s) 10, and separately applied to any of the formwork, for example to secure formwork to a casting bed and/or to secure form liner sheets 12 and/or layout members 10 to one another. Spray adhesive has been found to work well in the field.

In some embodiments, a form liner sheet 12 can be provided with an adhesive arranged to engage a layout member 10. For example, an adhesive can be provided on an underside of the form liner sheet 12.

Figure 4:
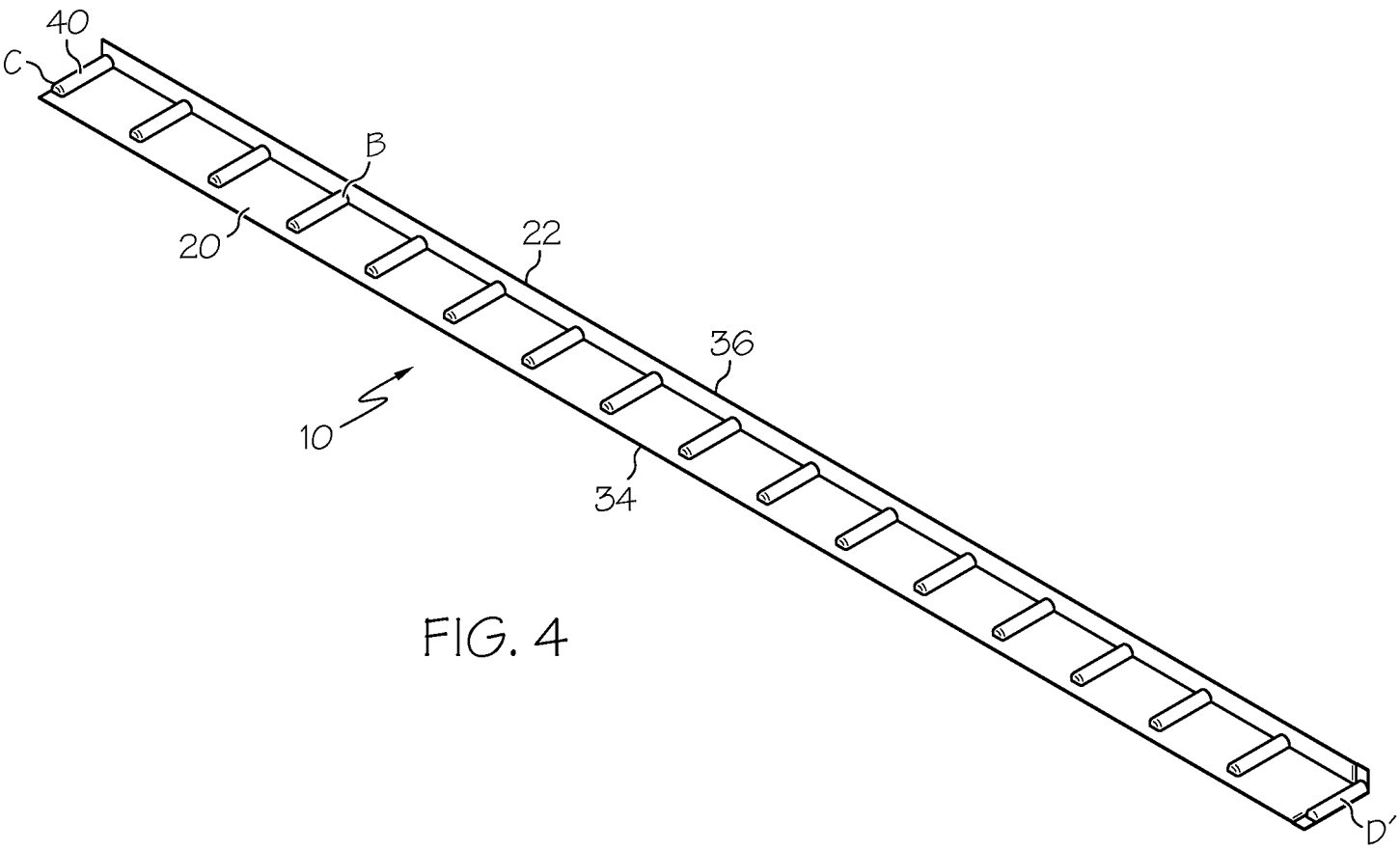
FIG. 4 shows another embodiment of a layout member.

FIG. 4 shows another embodiment of a layout member 10. In some embodiments, a layout member 10 comprises a base portion 20 and a second portion 22 oriented at a non-zero angle to the base portion 20. In some embodiments, the second portion 22 extends orthogonal to the base portion 20. In some embodiments, the raised portions 40 extend to and abut the second portion 22. In some embodiments, the base portion 20 extends to a first side 34 of the layout member 10, while the second portion 22 is located at a second side 36.

The layout member 10 shown in FIG. 4 is suitable for use at an end of a casting bed. For example, the layout member 10 can be placed at the desired end of a cured wall, wherein the second portion 22 defines where an end of the wall will be. A form liner sheet 12 can be placed to overlay the first side 34 of the layout member 10. When a curable material, such as concrete, is poured upon the form liner sheet 12 and layout member 10, the second portion 22 limits migration of the concrete and provides a form for the concrete.

FIGS. 1-4 illustrate embodiments of layout members 10 designed to lay underneath a formliner sheet 12. In some embodiments, layout members 10 are configured to overlay a formliner sheet 12. Thus, in some embodiments, a layout member 10 can be placed upon a formliner sheet 12. Desirably, a layout member 10 configured for overlayment excludes the end caps 46 discussed above.

Figure 5:
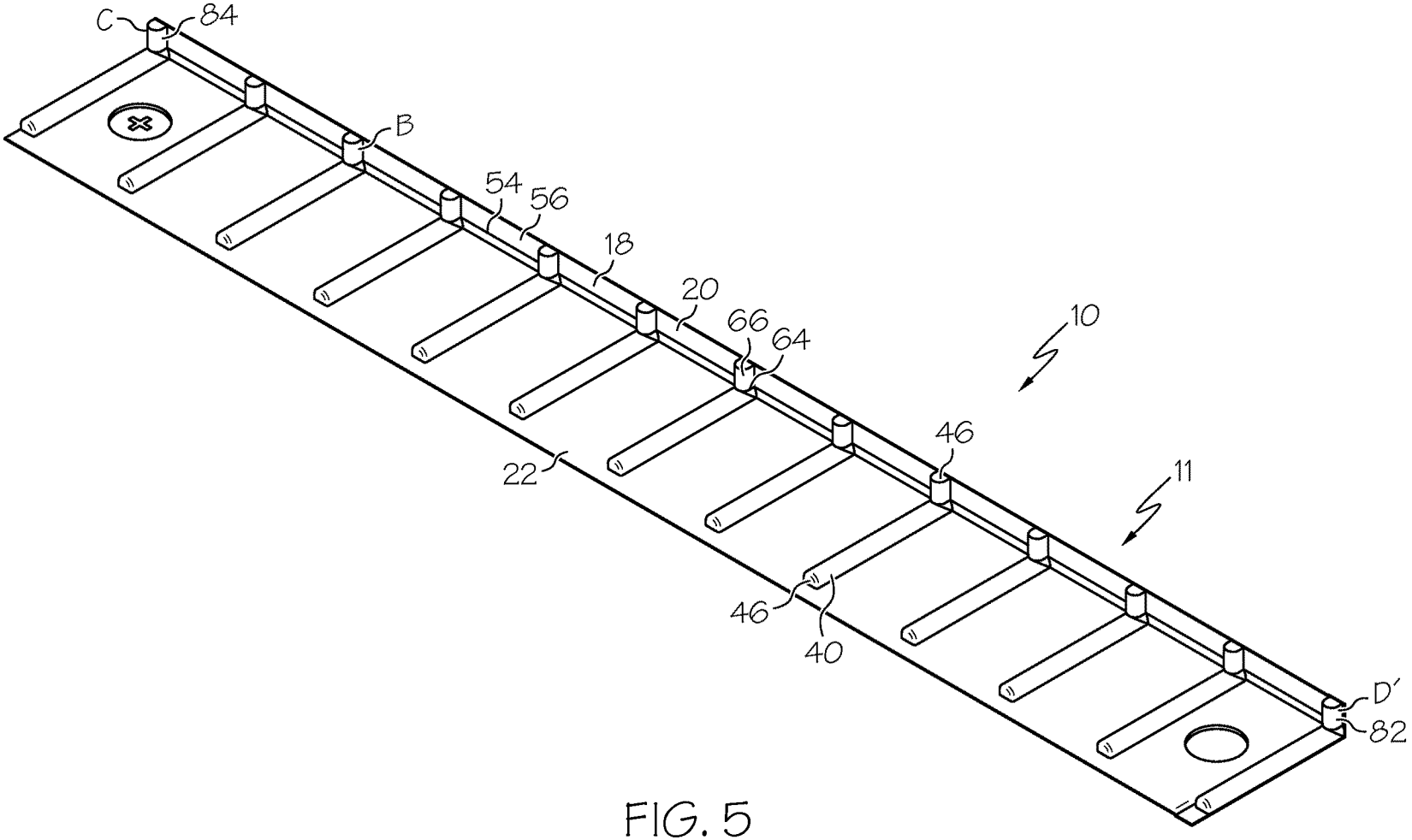
FIG. 5 shows an embodiment of a form liner system.
Figure 6:
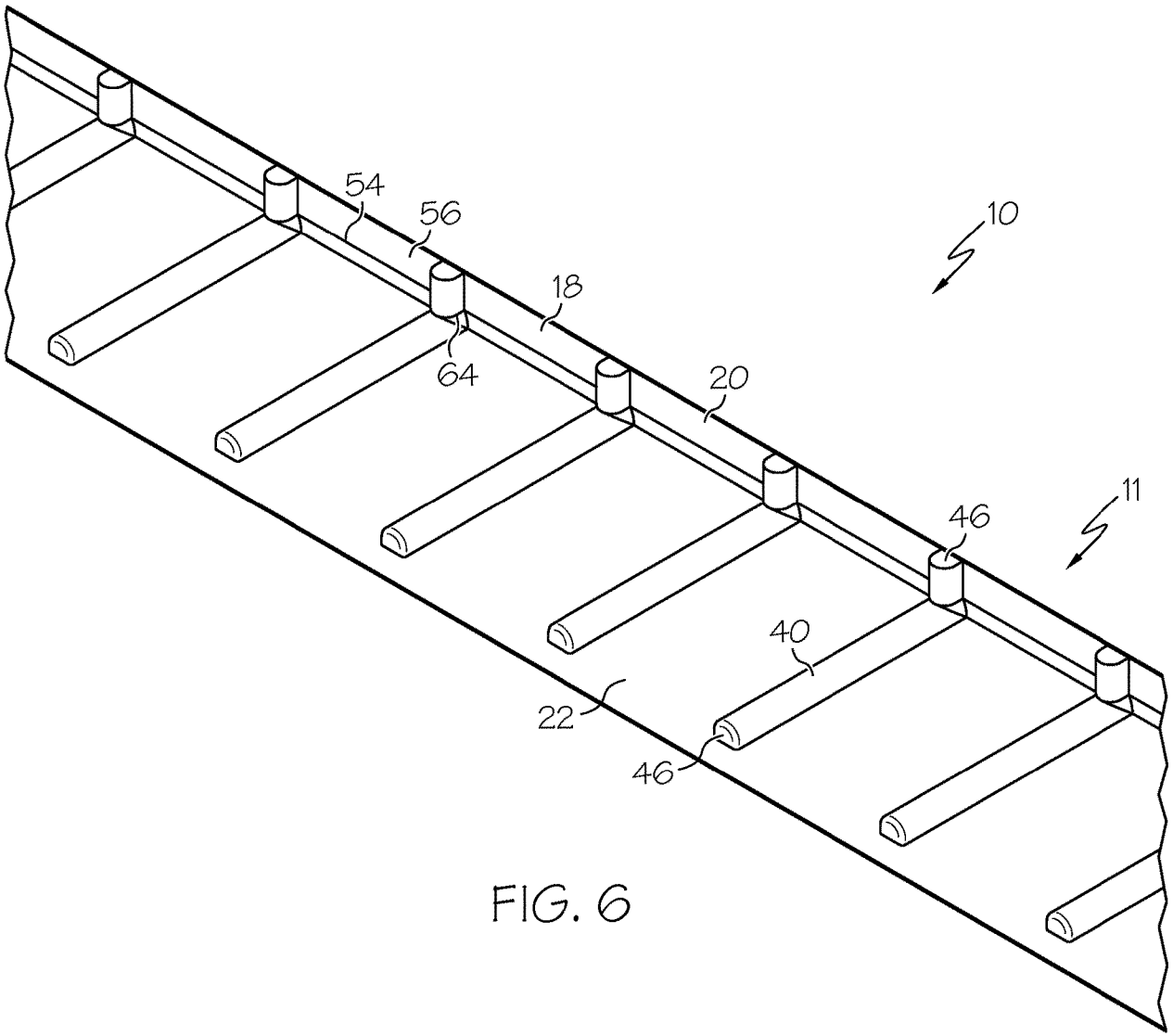
FIG. 6 shows another view of the form liner system of FIG. 5.

FIGS. 5 and 6 show another embodiment of a layout member 10. In some embodiments, a layout member 10 comprises a form liner joint 11. Desirably, a form liner joint 11 comprises a first portion 20 and a second portion 22. In some embodiments, each portion 20, 22 extends in a given plane. Desirably, the first portion 20 is oriented at an angle to the second portion 22. In some embodiments, first portion 20 and the second portion 22 are oriented at 90 degrees to one another. In various embodiments, the first portion 20 and the second portion 22 can be arranged at any suitable non-zero angle to one another.

Desirably, a form liner joint 11 comprises a plurality of raised portions 40 as herein described, and the raised portions 40 extend up the second portion 22, such that the second portion 22 comprises raised portions 40. A form liner joint 11 is suitable to form a wall corner section, wherein two walls meet at an angle.

In some embodiments, at least one end of a raised portion 40 comprises a cap 46, wherein the end of the raised portion 40 is solid (e.g. does not include any aperture). In some embodiments, each end of a raised portion 40 comprises a cap 46.

In some embodiments, at least one of said portions 20, 22 comprises an edge 18 arranged for overlap with a form liner sheet 12.

Figure 7:
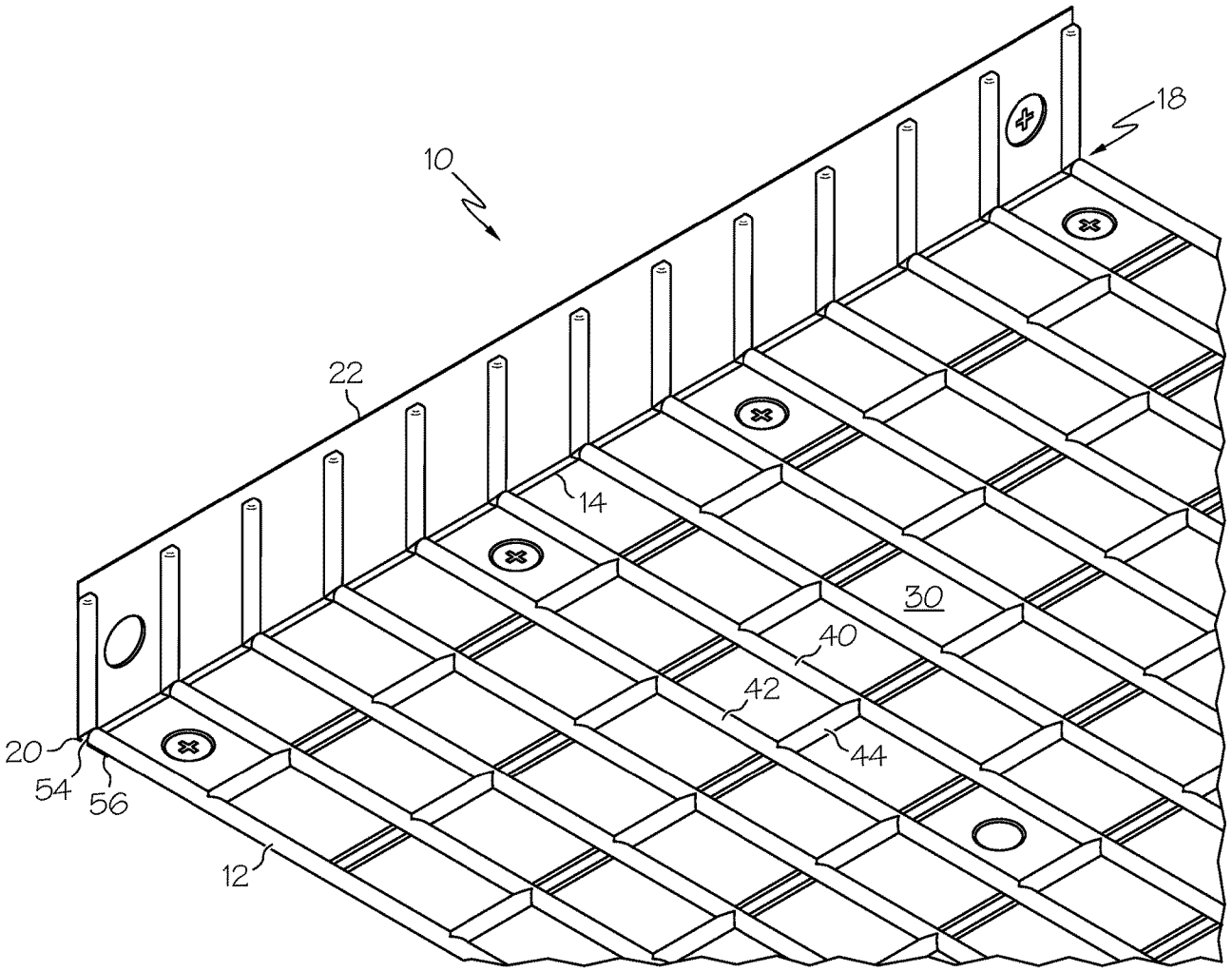
FIG. 7 shows a portion of FIG. 5 in greater detail.

FIG. 7 shows an embodiment of a form liner sheet 12 that is configured to create a cured wall that resembles traditional brick and mortar construction using thin brick inserts. The form liner sheet 12 is positioned to overlay an edge 18 of the form liner joint 11.

In some embodiments, a form liner joint 11 is configured to be used with a form liner sheet 12. Thus, the raised portions 40 of the form liner joint 11 and the raised portions 40 of the form liner sheet 12 can be similar in size and shape. In some embodiments, the raised portions 40 comprise similar surface texturing. In some embodiments, the raised portions 40 are spaced at similar intervals.

Referring again to FIGS. 5 and 6, an edge 18 of the form liner joint 11 can be arranged for overlap with a form liner sheet 12. In some embodiments, an edge 18 comprises a jog 54 that forms a stepped portion 56. In some embodiments, the stepped portion 56 is lowered and provides a floor for a form liner sheet 12 to rest upon. In some embodiments, a height of the jog 54 is approximately equal to a thickness of the form liner sheet 12.

In some embodiments, a raised portion 40 of a form liner sheet 12 can overlap a raised portion 40 of a form liner joint 11. In some embodiments, raised portions 40 located at an edge 18 of a form liner joint 11 are configured for overlap by raised portions of a form liner sheet 12. In some embodiments, a raised portion 40 comprises a jog 64 and a stepped down portion 66. In some embodiments, the jog 64 of raised portions 40 comprises a continuation of the jog 54 extending through the flat portion(s) of the form liner joint 11.

In some embodiments, a jog 64 and a stepped down portion 66 are configured to mate with a raised portion 40 of a form liner sheet 12. For example, FIG. 7 shows the row members 42 of the form liner sheet 12 overlaying the stepped down portions 66 of the raised members 40 of the form liner joint 11. The form liner sheet 12 overlays the stepped down portion 56 of the form liner joint 11, and an edge 14 of the form liner sheet 12 abuts the jog 54 of the form liner joint 11. In some embodiments, an upper surface (e.g. outer contour) of the stepped down portion 66 is sized to mate with an underside (e.g. inner contour) of the row member 42 of the second form liner 16. Thus, a stepped down portion 66 can be slightly smaller than a row member 42, for example comprising a smaller arc length, having a smaller radius, etc.

Although FIGS. 5-7 illustrate a form liner system comprising a form liner sheet 12 arranged to overlay a form liner joint 11, the configuration can be reversed. Thus, in some embodiments, the form liner joint 11 overlays a portion of the form liner sheet 12, and the form liner sheet 12 can comprise the jogs 54, 64 and stepped portions 56, 66 described herein with respect to a form liner joint 11.

Figure 8:
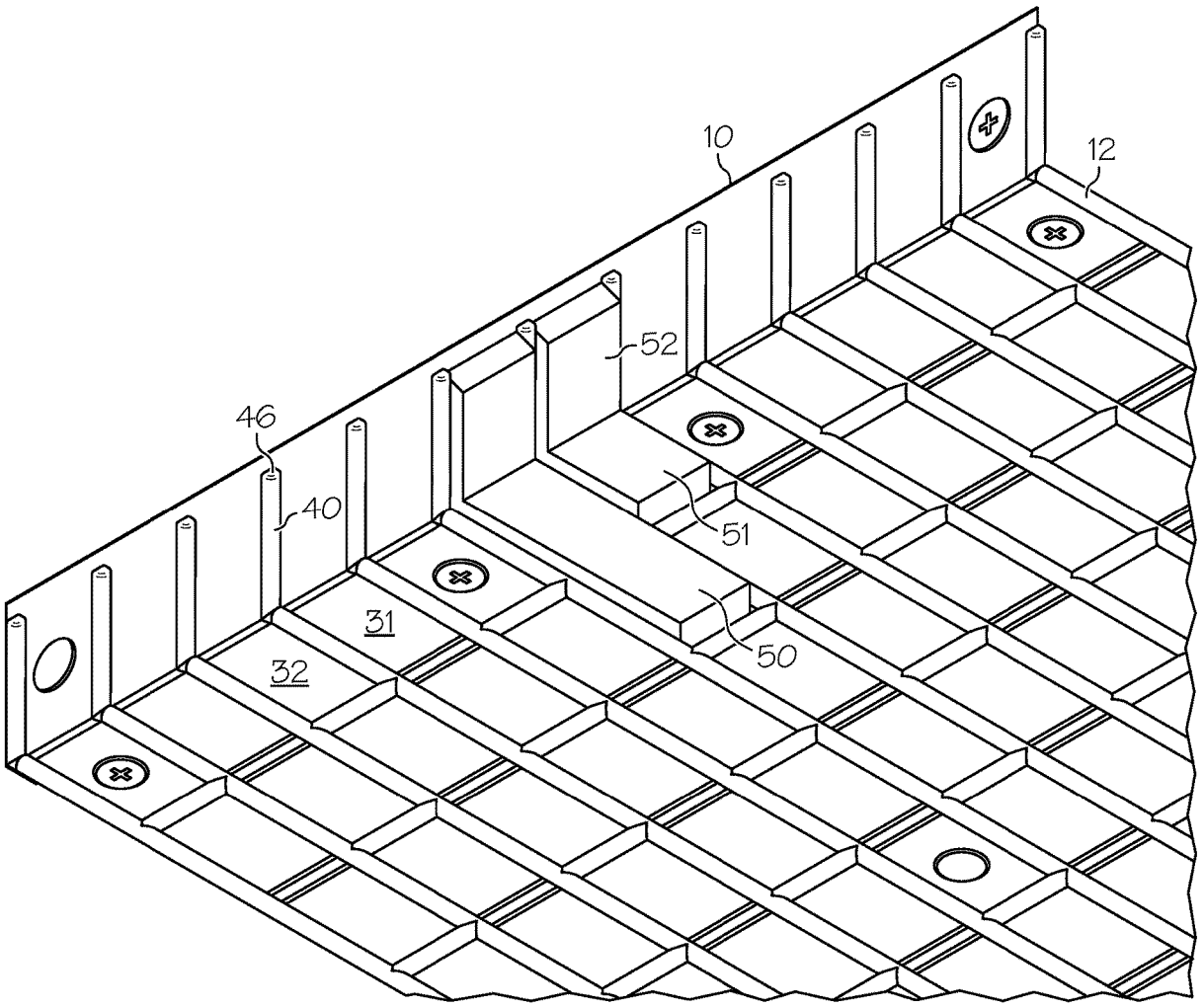
FIG. 8 shows another embodiment of a form liner system.

FIG. 8 shows embodiments of the form liner joint 11 and form liner sheet 12 similar to that of FIG. 7, but further having thin bricks 50. In some embodiments, a thin brick 50 is arranged to be placed in a corner, comprising a first portion 51 oriented at an angle to a second portion 52.

In some embodiments, the cell pattern 30 of the form liner sheet 12 is arranged in a standard running bond layout, and an end of the form liner sheet 12 can include alternating full cells 31 and partial cells 32. In some embodiments, a thin brick 50 configured for a corner location comprises a first portion 51 of standard brick dimensions, for example sized to fit in a full cell 31. In some embodiments, a thin brick 50 configured for a corner location comprises a first portion 51 of a reduced dimension, for example sized to fit in a partial cell 32.

FIG. 8 helps to show the benefit of caps 46 on the raised portions 40 of the form liner joint 11. In some embodiments, a height of the concrete poured onto the form liner sheet 12 and thin bricks 50 exceeds the height of the thin bricks 50. For example, in FIG. 8, a height of the concrete can be taller than the height of the second portion 52 of the thin bricks 50. In this situation, the caps 46 on the raised portions 40 prevent concrete from migrating into/behind the raised portions 40.

Figure 9:
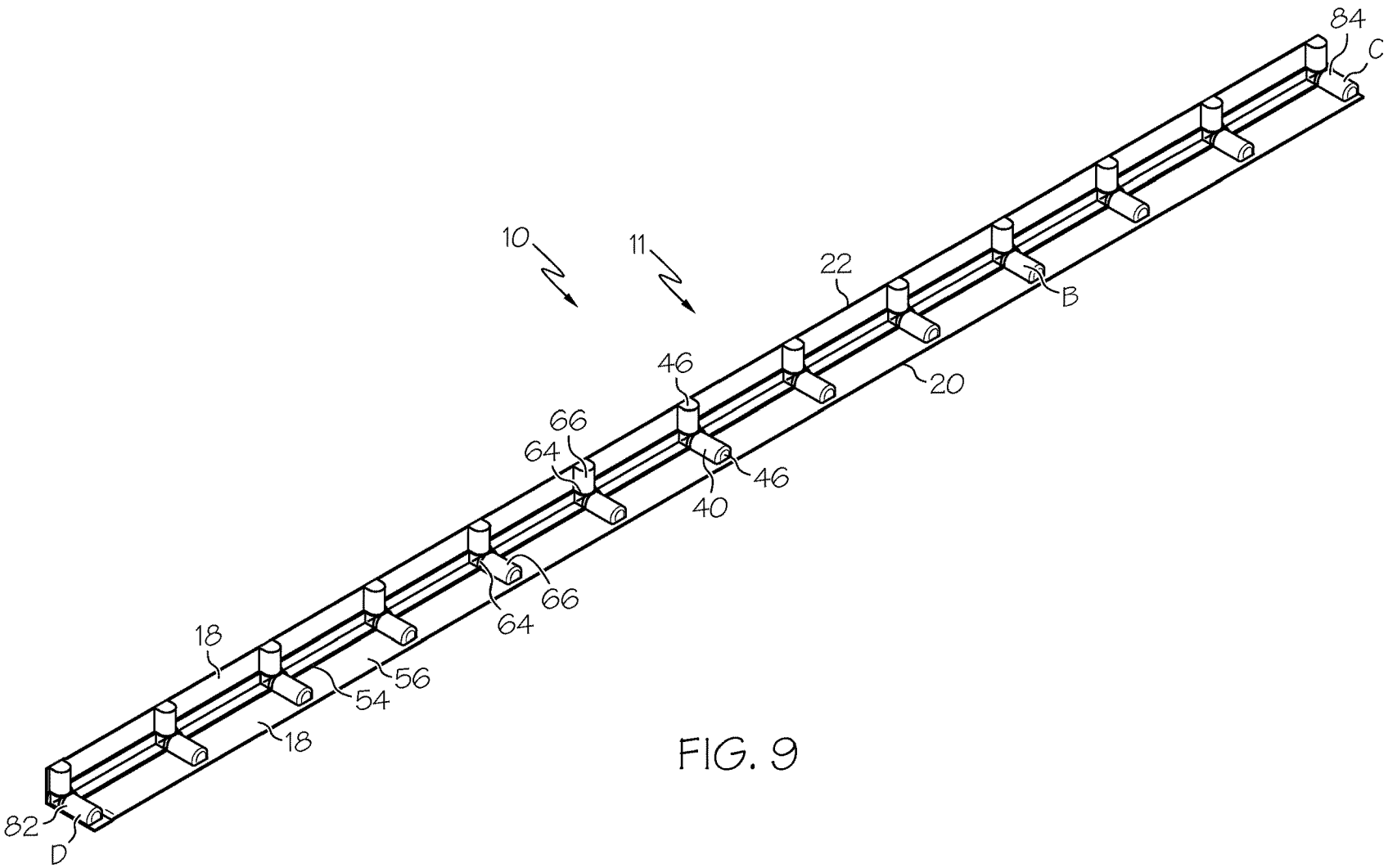
FIG. 9 shows the embodiment of FIG. 8 from an alternate viewing angle.
Figure 10:
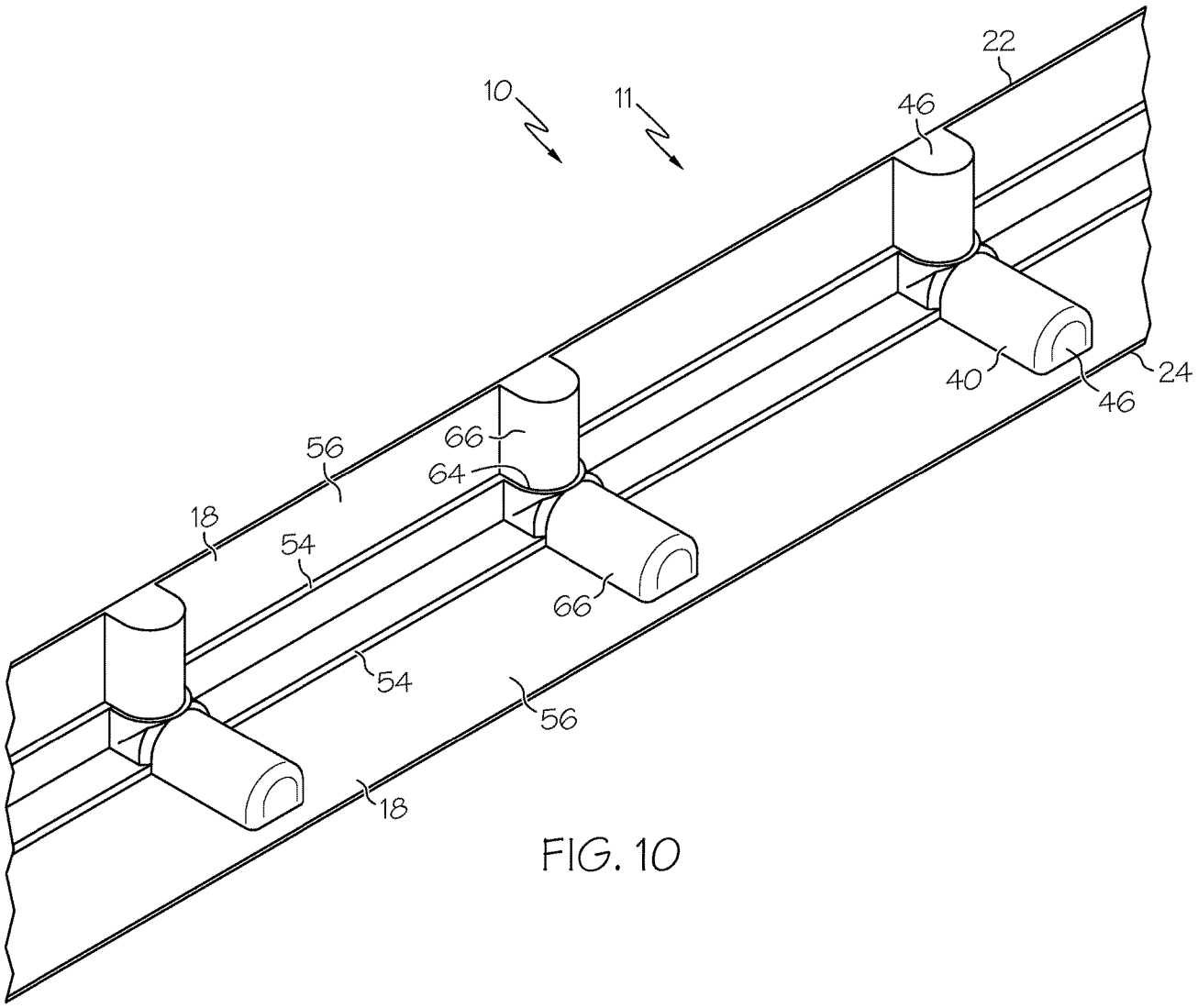
FIG. 10 shows another embodiment of a form liner system.

FIGS. 9 and 10 show another embodiment of a form liner joint 11. In some embodiments, each portion 20, 22 of a form liner joint 11 comprises an edge 18 that is arranged for overlap with a form liner sheet 12. Thus, each of the portions 20, 22 can comprise a jog 54 and a stepped portion 56, and the raised portions of each of the portions 20, 22 can comprise a jog 64 and a stepped portion 66. In some embodiments, a raised portion (e.g. 40) comprises a first portion and a second portion 66, wherein the second portion 66 has a reduced size compared to the first portion. A jog 64 represents a change in size between the first portion and the second portion 66.

Figure 11:
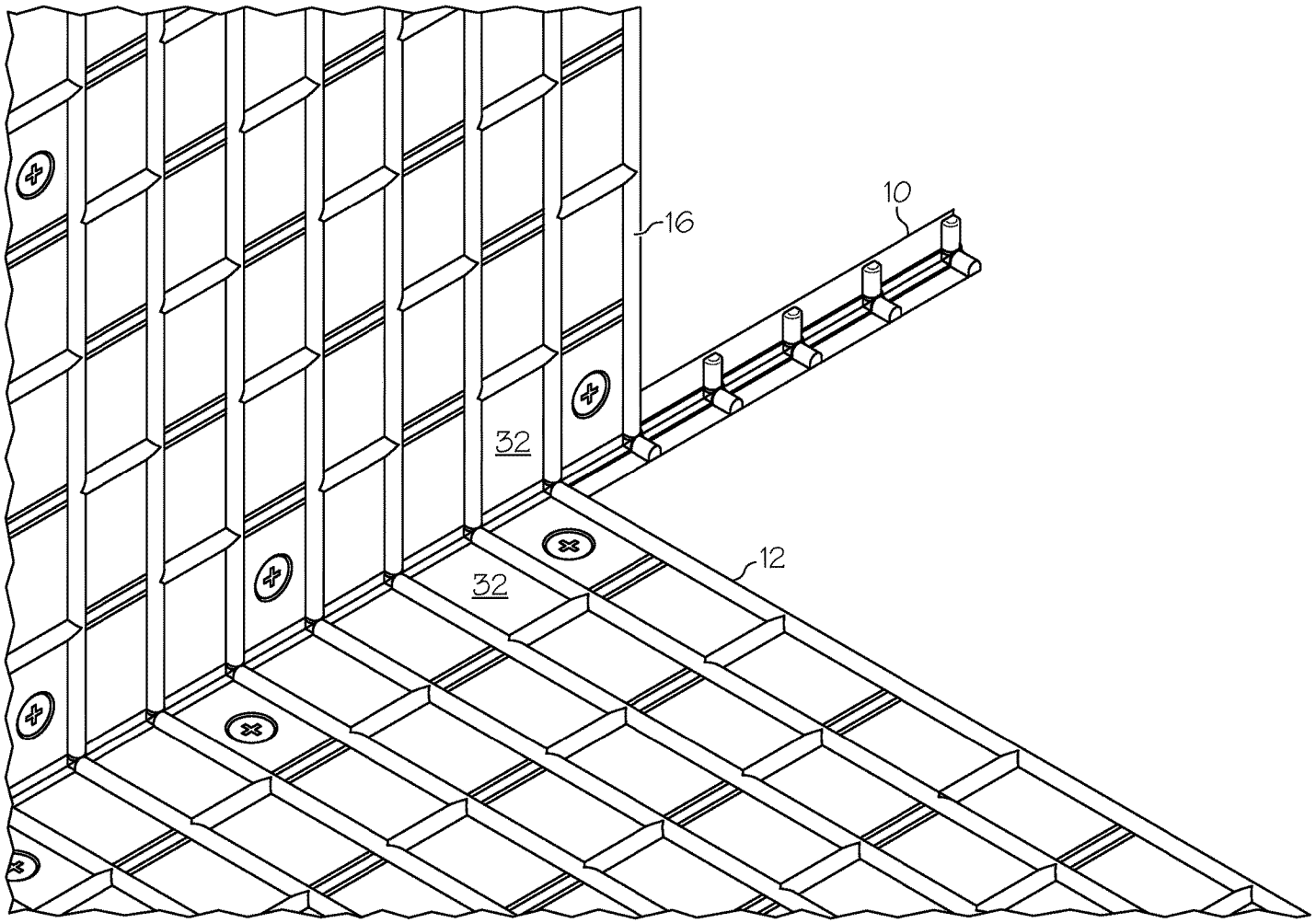
FIG. 11 shows another embodiment of a form liner system.

FIG. 11 shows the form liner joint 11 of FIGS. 9 and 10 being used with a first form liner sheet 12 and a second form liner sheet 16.

In some embodiments, a first form liner sheet 12 comprises cells 30 having a shape similar to cells 30 of a second form liner sheet 16. In some embodiments, a first form liner sheet 12 and a second form liner sheet 16 have similar repeating cell 30 patterns. In some embodiments, a first form liner 12 and a second form liner 16 are similar in size and shape. In some embodiments, the first form liner 12 and the second form liner 16 are substantially identical.

In some embodiments, a first form liner 12 comprises a partial cell 32 and a second form liner 12 comprises a partial cell 32. The partial cells 32 can be staggered to achieve the look of a traditional running bond brick pattern.

Although FIGS. 9-11 illustrate a form liner system comprising form liner sheets 12, 16 arranged to overlay a form liner joint 11, the configuration can be reversed.

Thus, in some embodiments, the form liner joint 11 overlays a portion of each of the form liner sheets 12, 16, and the form liner sheets 12, 16 can each comprise the jogs 54, 64 and stepped portions 56, 66 described herein with respect to a form liner joint 11.

In some embodiments, the various form liner sheets 12 and various layout member 10 embodiments described herein are constructed and arranged to overlap and properly nest with one another. Thus, the spacing between raised portions 40 is desirably coordinated. Further, in some embodiments, various raised portions are slightly different in size to achieve proper nesting.

Figure 12:
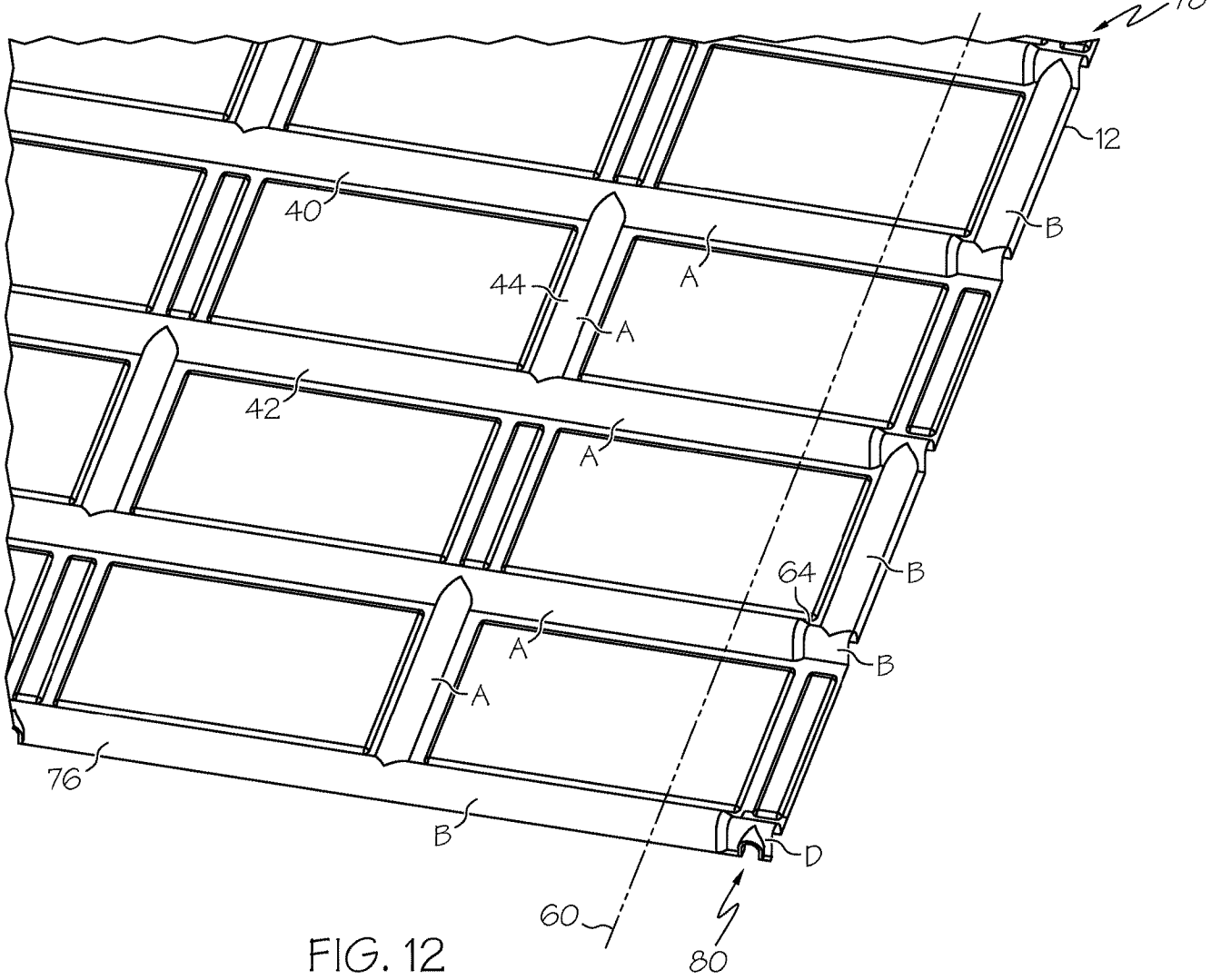
FIG. 12 shows an embodiment of a form liner sheet.
Figure 13:
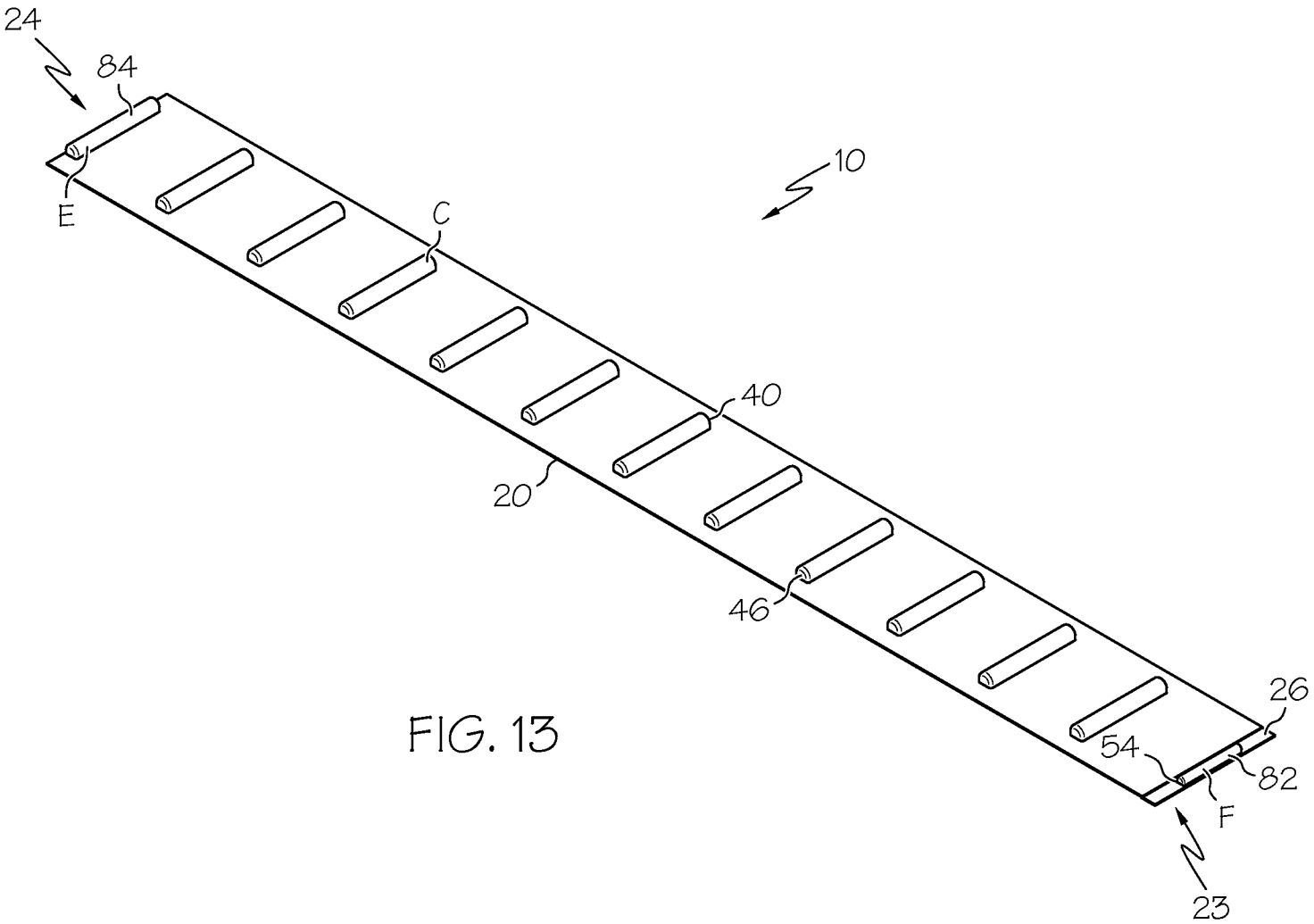
FIG. 13 shows another embodiment of a layout member.
Figure 14:
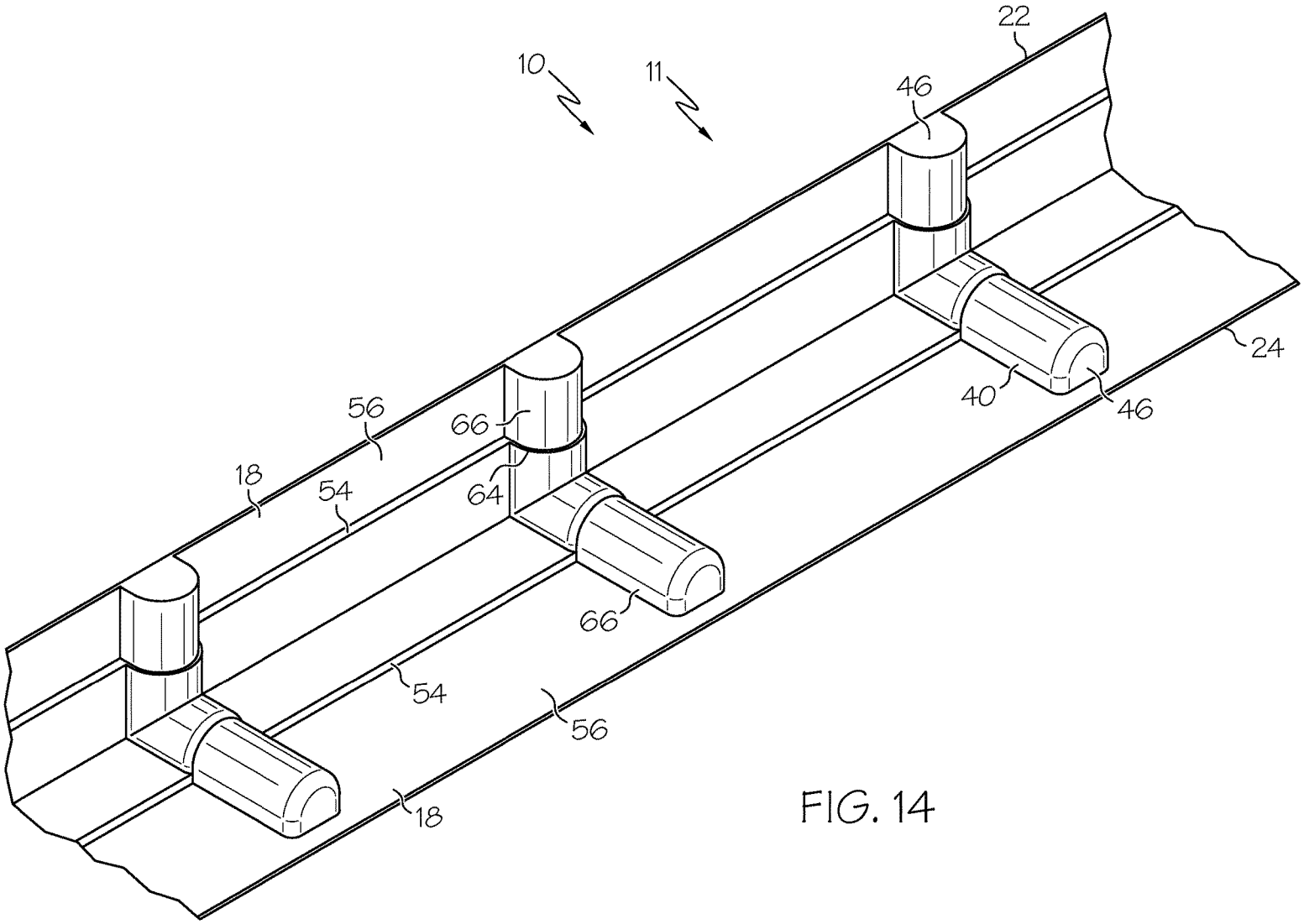
FIG. 14 shows another embodiment of a form liner layout member.

FIG. 12 shows an embodiment of a form liner sheet 12, specifically a corner. In some embodiments, a form liner sheet 12 is constructed and arranged to be used with multiple other form liner sheets 12, and is therefore configured to overlap another form liner sheet 12 and/or be overlapped by another form liner sheet 12.

In order for the various raised portions described herein with respect to form liner sheets 12 and layout members 10 to properly nest, it is desirable for the raised portions to be sized appropriately to fit underneath one another. The raised portions of various Figures are labeled with relative sizing A-F, wherein each letter is sized to nest properly with the next successive size. Thus, arc A is the largest, arc B is sized to nest underneath arc A, arc C is sized to nest underneath arc B, ect.

In some embodiments, most of the row members 42 of a form liner sheet 12 generally have a first size A, but a last row member 76 has a second size B. Thus, the last row member 76 is sized to be overlapped by a row member 42 of size A, such as a row member 42 of another form liner sheet 12.

In some embodiments, most of the column members 44 of a form liner sheet 12 generally have a first size A, but a last column member 78 has a second size B. Thus, the last column member 78 is sized to be overlapped by a column member 44 of size A, such as a column member 44 of another form liner sheet 12.

In some embodiments, each row member 42 is reduced in size at locations where it intersects a last column member 78. Thus, a row member 42 of size A may step down to having size B where it interests the last column member 78. A jog 64 can comprise a transition from one size (e.g. size A) to another size (e.g. size B).

In some embodiments, at a location 80 where a last row member 76 intersects a last column member 78, the last row member 76 is further reduced in size at the location to a fourth size D.

In some embodiments, a layout member 10 is constructed and arranged to be used with a form liner sheet 12 as described with respect to FIG. 12. Referring again to FIG. 1, in some embodiments, a layout member 10 has the same number of raised portions 40 as a form liner sheet 12 has row members 42, at a similar spacing. In some embodiments, each raised portion 40 of the layout member 10 is sized to appropriately nest underneath the row members 42 at their intersection locations with the last column member 78 of a form liner sheet 12. Thus, in some embodiments, most raised portions 40 of the layout member 10 are a third size C, sized to nest underneath the reduced row members 42 of size B located in the last column member 78.

In some embodiments, a last raised portion 82 of a layout member 10 is sized to underlay an intersection 80 of a last row member 76 and last column member 78 (which is the fourth size D)—thus, in some embodiments, a last raised portion 82 is a fifth size E.

In some embodiments, a first raised portion 84 of a layout member 10 is sized to underlay an intersection 80 of a last row member 76 and last column member 78 (which is the fourth size D)—thus, in some embodiments, a first raised portion 84 is a fifth size E. In some embodiments, the layout member 10 is also arranged to overlap and or be overlapped by adjacent layout members 10, in addition to be overlapped by form liner sheet(s) 12. Thus, in some embodiments, a last raised portion 82 nests within a first raised portion 84 (of size E) of another layout member 10—and the last raised portion 82 is a smaller sixth size F.

It should be noted that these listed relative sizes on the layout member 10 are maximum sizes that properly nest underneath a form liner sheet 12, and that the sizes of raised portions 10 can be reduced while still performing the positioning and layout functions of the layout member 10.

Any embodiment of a layout member 10 can follow the relative sizing C, E, F configuration discussed with respect to the raised portions 40 of FIG. 1, wherein a first raised portion 84 has an intermediate size, the last raised portion 82 has the smallest size and the remaining raised portions 40 have the largest size of the layout member 10.

In some embodiments, a form liner sheet 12 has a thickness of approximately 0.023". In some embodiments, a layout member has a thickness of approximately 0.023".

In some embodiments, an arc size A comprises a height of 0.25" and a width of 0.416". In some embodiments, an arc size B comprises a height of 0.25" and a width of 0.370". In some embodiments, an arc size C comprises a height of 0.227" and a width of 0.337". In some embodiments, an arc size D comprises a height of 0.204" and a width of 0.288". In some embodiments, an arc size E comprises a height of 0.227" and a width of 0.257". In some embodiments, an arc size F comprises a height of 0.204" and a width of 0.217".

In some embodiments, a layout member 10 includes raised portions 40 sized for use with a form liner sheet 12 that excludes a last column member 78. Referring to FIG. 12, a reference line 60 is shown on the form liner sheet 12. In some embodiments, the sizing of the row members 42 at the edge of a form liner sheet 12 is similar to the sizing of row members 42 at the reference line 60. A form liner sheet 12 can be provided with such a configuration, or in some embodiments, a last column member 78 can be removed (e.g. cut off) in the field. Thus, in some embodiments, a layout member 10 includes raised portions 40 sized for use with a form liner sheet 12 having row members 42 of size A and a last row member 76 of size B.

Referring to FIG. 5, in some embodiments, a layout member 10 comprises a first raised portion 84 of size C (sized to nest underneath a last row member 76), a last raised portion 82 of size D' (sized to nest underneath a first raised portion 84 of another layout member 10) and the remaining raised portions 40 have size B. The embodiment shown in FIG. 4 can have a similar sizing configuration.

In some embodiments, an arc size B comprises a height of 0.25" and a width of 0.370". In some embodiments, an arc size C comprises a height of 0.227" and a width of 0.337". In some embodiments, an arc size D' comprises a height of 0.227" and a width of 0.288".

Although the relative sizing A-F discussed above applies to embodiments of a layout member 10 configured to lay underneath a form liner sheet 12, the invention is also directed to layout members 10 configured to lay upon the form liner sheet 12. Thus, the relative sizes of raised portions 40 of the layout member 10 can be larger than the raised portions of the form liner sheet 12.

In various embodiments, layout members 10 and form liner sheets 12 can comprise any suitable material, such as thermoplastics (e.g. HIPS, PVC, polyolefins, ABS, thermoplastic elastomers, etc.), thermoplastic foams, elastomers (e.g. polyurethane rubber, silicone rubber, etc.), natural rubbers, fiber products (e.g. fiberglass, molded paper, etc.) and suitable combinations thereof.

In some embodiments, a form liner joint comprises a first portion oriented at an angle to a second portion, and a plurality of raised portions. Each raised portion extends from the first portion to the second portion. The first portion comprises a jog and a stepped portion. In some embodiments, each raised portion comprises a jog aligned with the first portion jog, and each raised portion comprises a stepped portion aligned with the first portion stepped portion. In some embodiments, the second portion comprises a jog and a stepped portion. In some embodiments, each raised portion comprises a second jog aligned with the second portion jog, and each raised portion comprises a second stepped portion aligned with the second portion stepped portion. In some embodiments, the raised portions each comprise one or more end caps.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A form liner system comprising:

a form liner sheet comprising a plurality of raised rows at a predetermined spacing and a plurality of raised column members, said column members non-parallel to said raised rows; and a layout member shaped differently from said form liner sheet, said layout member comprising a base portion and a plurality of raised portions, said plurality of raised portions comprising a first raised portion, a second raised portion and a third raised portion oriented parallel to one another, said second raised portion oriented between said first raised portion and said third raised portion, said base portion comprising a continuous planar area, said continuous planar area having a length that exceeds a distance between said first raised portion and said third raised portion;

wherein said raised portions are constructed and arranged to nest with said raised rows.

2. The form liner system of claim 1, wherein said layout member is configured for placement underneath said form liner sheet, each raised portion sized to nest under any portion of one of said raised rows.

3. The form liner system of claim 1, wherein said layout member is configured for placement above said form liner sheet.

4. The form liner system of claim 1, wherein a spacing of said raised portions is similar to said predetermined spacing of said raised rows.

5. The form liner system of claim 1, said layout member base portion comprising a stepped portion, a width of said stepped portion oriented parallel to said raised portions.

6. The form liner system of claim 1, wherein each raised portion comprises at least one end cap.

7. The form liner system of claim 1, said layout member further comprising a sidewall portion, said sidewall portion oriented at an angle to said base portion.

8. The form liner system of claim 7, wherein said raised portions abut said sidewall.

9. The form liner system of claim 7, wherein said raised portions comprise raised base portions, said sidewall comprises a plurality of raised sidewall portions, and said raised sidewall portions extend non-parallel to said raised base portions.

10. The form liner system of claim 9, wherein the raised base portions are aligned with said raised sidewall portions along a length of said layout member.

11. A form liner layout member comprising:

a first base portion, a second base portion and a plurality of raised portions, the first base portion oriented at an angle to the second base portion, each raised portion comprising a first portion protruding form the first base portion and a second portion protruding from the second base portion, the first portion transitioning into the second portion, the first portions extending parallel to one another, each raised portion comprising at least one end cap, at least one of said raised portions comprising a hollow underside;

said layout member suitable for use with a form liner sheet that comprises a plurality of raised rows, said form liner sheet positionable with respect to said layout member such that said form liner sheet contacts said base portion and said raised portions nest under said raised rows.

12. The form liner of claim 11, wherein one of said raised portions comprises a smaller raised portion having a smaller size than other raised portions.

13. The form liner of claim 12, wherein said smaller raised portion is sized to nest in said hollow underside.

14. The form liner of claim 11, said base portion comprising a stepped end portion.

15. The form liner system of claim 6, wherein each raised portion further comprises a second end cap.

16. The form liner of claim 11, wherein at least one raised portion comprises a first portion and a second portion, the second portion having a reduced size compared to the first portion.

17. The form liner of claim 11, wherein each raised portion comprises a first portion and a second portion, the second portion having a reduced size compared to the first portion.

* * * * *